US009783748B2

(12) United States Patent
Harvey et al.

(10) Patent No.: US 9,783,748 B2
(45) Date of Patent: Oct. 10, 2017

(54) PROCESS FOR PRODUCING DIESEL FUEL

(71) Applicant: UOP LLC, Des Plaines, IL (US)

(72) Inventors: Craig Harvey, Houston, TX (US); Haiyan Wang, Hoffman Estates, IL (US); B. Daniel Thomas, Holly Springs, NC (US); Brian Ganyu, Gurnee, IL (US); Jagannathan Govindhakannan, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 424 days.

(21) Appl. No.: 14/481,461

(22) Filed: Sep. 9, 2014

(65) Prior Publication Data

US 2016/0068767 A1 Mar. 10, 2016

(51) Int. Cl.

| | |
|---|---|
| ***C10G 67/06*** | (2006.01) |
| ***C10G 67/04*** | (2006.01) |
| ***C10G 67/14*** | (2006.01) |
| ***C10L 1/02*** | (2006.01) |

(52) U.S. Cl.

CPC ..... *C10G 67/049* (2013.01); *C10G 67/0454* (2013.01); *C10G 67/14* (2013.01); *C10L 1/026* (2013.01); *C10G 2400/04* (2013.01)

(58) Field of Classification Search

CPC ..... C10G 67/049; C10G 67/06

See application file for complete search history.

(56) References Cited

U.S. PATENT DOCUMENTS

| | | | | |
|---|---|---|---|---|
| 2,973,313 | A * | 2/1961 | Pevere | C10G 47/00 208/108 |
| 6,533,925 | B1 | 3/2003 | Wallace et al. | |
| 7,279,090 | B2 | 10/2007 | Colyar et al. | |
| 8,110,090 | B2 | 2/2012 | Zimmerman et al. | |
| 8,193,401 | B2 | 6/2012 | McGehee et al. | |
| 8,287,720 | B2 | 10/2012 | Baldassari et al. | |
| 8,343,334 | B2 | 1/2013 | Koseoglu | |
| 8,372,266 | B2 | 2/2013 | Biswas et al. | |
| 8,574,425 | B2 | 11/2013 | Hoehn et al. | |
| 8,636,896 | B2 | 1/2014 | Gueret et al. | |
| 2010/0078359 | A1* | 4/2010 | Serban | B01J 20/3416 208/310 R |
| 2010/0320122 | A1* | 12/2010 | Baldassari | C10G 21/003 208/96 |
| 2010/0326883 | A1 | 12/2010 | Van Wees et al. | |
| 2011/0139681 | A1* | 6/2011 | McGehee | C10G 21/003 208/96 |
| 2011/0142729 | A1 | 6/2011 | McGehee et al. | |
| 2013/0112593 | A1 | 5/2013 | Montanari et al. | |
| 2013/0180888 | A1 | 7/2013 | Corscadden et al. | |
| 2013/0206642 | A1* | 8/2013 | Zhao | C10G 55/04 208/14 |
| 2013/0240407 | A1 | 9/2013 | Gillis | |
| 2013/0319910 | A1 | 12/2013 | Koseoglu et al. | |

OTHER PUBLICATIONS

Baldassari el al., "LC-MAX and Other LC-FINING Process Enhancements to Extend Conversion and On-stream Factor", AFPM Annual Meeting 2012, 21st International Specialty Conference on Cold-Formed Steel Structures, Mar. 2012, pp. 504-519.

De Haan et al., "New Residue-Upgrading Complex Achieves Euro 5 Specifications", Hydrocarbon Processing, Feb. 2, 2013, vol. 92, No. 2, pp. 6 pages.

Faupel et al., "Debottleneck Refinery Operations by Integrating the H-Oil Process With a Deasphalter", AIChE 1990 Summer National Meeting, San Diego, 1991, vol. 87, No. 282, pp. 44-52.

U.S. Appl. No. 13/869,736, filed Apr. 24, 2013, Richmond.

"Smart Engineering Behind Boost for Refinery", Press Release of Refining NZ, Jul. 30, 2014, pp. 2.

Ng, "Nonconventional Residuum Upgrading by Solvent Deasphalting and Fluid Catalytic Cracking", Energy & Fuels, 1997, vol. 11, No. 6, pp. 1127-1136.

Frazer et al., "Improving Commercial Hydrocracking Performance", "Asian Refining Technology Conference—Singapore", Apr. 1999, Publisher: The New Zealand Refining Company Limited, Published in: Whangarei, New Zealand, pp. 39 pages.

Sudoh et al., "Upgrading of Heavy Oils by Asphaltenic Bottom Cracking", 185th ACS National Meeting, Seattle Meeting Mar. 20-25, 1983, Mar. 20, 1983, vol. 28, No. 3, pp. 600-620.

U.S. Appl. No. 14/481,482, filed Sep. 9, 2014, Ganyu.

Abstract of CN101418222B, published Sep. 12, 2012, 1 page, Ge et al.

* cited by examiner

*Primary Examiner* — Randy Boyer

(57) ABSTRACT

One exemplary embodiment can be a process for producing a diesel fuel. The process can include providing a hydrocarbon feed to a residue processing unit. Generally, the residue processing unit includes a solvent deasphalting zone, a hydroprocessing zone, and a hydroprocessing fractionation zone. The process can further include recycling at least a portion of an unconverted oil stream from the hydroprocessing fractionation zone, and sending one part of the at least a portion of the recycled unconverted oil stream to the unconverted oil fractionation zone providing a light unconverted oil stream downstream of the solvent deasphalting zone and a heavy unconverted oil stream to the solvent deasphalting zone.

20 Claims, 3 Drawing Sheets

PROCESS FOR PRODUCING DIESEL FUEL

FIELD OF THE INVENTION

This invention generally relates to a process for producing diesel fuel.

DESCRIPTION OF THE RELATED ART

As the price of crude rises, more refineries explore the possibility of upgrading the heavier fractions, such as a vacuum residue or resid, which may be purchased at a much lower cost. There are several available processes for upgrading heavier fractions, such as resid. In particular, a hydrocracking (HC) unit integrated with a solvent deasphalting (SDA) unit has been considered as a viable and cost-effective option for resid upgrading to produce high-quality diesel fuel. In this process, the SDA unit extracts deasphalted oil (DAO) from the resid feed, which can be obtained from a vacuum or an atmospheric column. The DAO may then enter the HC unit after combining with a vacuum gas oil (VGO) to produce high-value products as well as an unconverted oil (UCO). The UCO can be either partially recycled or used as feed for fluid catalytic cracking, ethylene or lube production. If recycled, heavy poly-nuclear aromatics (HPNAs) present in the UCO have to be managed as HPNAs can cause fouling in the exchangers and coking on the catalysts. Several designs can be used to manage HPNA rejection, such as a steam stripper, wiped film evaporator (WFE) and carbon-bed adsorption. However, such integration with the SDA unit can have an adverse impact on the HC unit operation since DAO would significantly increase formation of HPNAs in the UCO. Thus, typically the catalyst lifecycle is reduced with an internal UCO recycle (RCO) while the conversion is lowered without the RCO. Balancing cycle length and conversion raises several operational challenges. As a consequence, there is a desire to integrate the HC unit and the SDA unit to allow the refinery to maximize the conversion and the cycle length in a flexible and effective way.

Additionally, hydrocracking can be a viable and cost-effective option to produce high-quality diesel fuel. However, UCO usually contains a significant amount of HPNAs that may also be produced in this process. The UCO can be either partially recycled or used as feed for lube production. If recycled, HPNAs present in the UCO have to be controlled to prevent exchanger fouling and catalyst coking, as discussed above. Although several designs may be used to manage HPNA rejection as discussed above, additional options for managing HPNAs are still desired as it would provide unit flexibility and effectiveness.

SUMMARY OF THE INVENTION

One exemplary embodiment can be a process for producing a diesel fuel. The process can include providing a hydrocarbon feed to a residue processing unit. Generally, the residue processing unit includes a solvent deasphalting zone, a hydroprocessing zone, and a hydroprocessing fractionation zone. The process can further include recycling at least a portion of an unconverted oil stream from the hydroprocessing fractionation zone, and sending one part of the at least a portion of the recycled unconverted oil stream to the unconverted oil fractionation zone providing a light unconverted oil stream downstream of the solvent deasphalting zone and a heavy unconverted oil stream to the solvent deasphalting zone.

Another exemplary embodiment may be a process for producing a diesel fuel. The process can include providing a residue processing unit. Often, the residue processing unit includes a solvent deasphalting zone, a hydrotreating zone, a hydrocracking zone, and a hydroprocessing fractionation zone. The process may further include providing a hydrocarbon feed to the hydrotreating zone, in turn providing an effluent to a hydrocracking zone, and in turn providing another effluent to the hydroprocessing fractionation zone, recycling at least a portion of an unconverted oil stream from the hydroprocessing fractionation zone to the solvent deasphalting zone, and sending a portion of an effluent from the solvent deasphalting zone to the hydrotreating zone and another portion of the effluent from the solvent deasphalting zone to the hydrocracking zone.

A further exemplary embodiment can be a process for producing a diesel fuel. The process can include providing a residue processing unit. Generally, the residue processing unit includes a feed fractionation zone, a solvent deasphalting zone, a hydroprocessing zone, and a hydroprocessing fractionation zone. The process may further include providing a hydrocarbon feed to the feed fractionation zone, in turn providing a light feed to the hydrotreating zone and a heavy feed combined with a recycled unconverted oil stream prior to being sent to the solvent deasphalting zone.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more. A "stream" may also be or include substances, e.g., fluids or substances behaving as fluids, other than hydrocarbons, such as air, hydrogen, or catalyst.

As used herein, the term "zone" can refer to an area including one or more equipment items and/or one or more sub-zones. Equipment items can include one or more reactors or reactor vessels, separators, strippers, extraction columns, fractionation columns, heaters, exchangers, pipes, pumps, compressors, and controllers. Additionally, an equipment item, such as a reactor, dryer, or vessel, can further include one or more zones or sub-zones.

As used herein, the term "vacuum gas oil" may be abbreviated herein as "VGO" and can mean a hydrocarbon material boiling in the range of about 343-about 565° C., and can include one or more C18-C50 hydrocarbons. The VGO may be prepared by vacuum fractionation of an atmospheric residue. Such a fraction is generally low in coke precursors and heavy metal contamination, which can serve to contaminate catalyst. Often, a VGO has a boiling range with an initial boiling point of about 340° C., a T5 of about 340-about 350° C., a T95 of about 555-about 570° C., and an end point of about 570° C.

As used herein, the term "atmospheric residue" may be abbreviated herein as "AR" and can mean a hydrocarbon material obtained from the bottoms of an atmospheric crude distillation column Generally, atmospheric residue is high in coke precursors and metal contamination. Often, an AR has a boiling range with an initial boiling point of about 340° C., a T5 of about 340-about 360° C., and a T95 of about 700-about 900° C.

As used herein, the term "vacuum residue" may be abbreviated herein as "VR" and can mean a hydrocarbon material boiling no less than about 530° C., and can include one or more $C40^+$ hydrocarbons.

As used herein, the term "unconverted oil" may be abbreviated herein as "UCO" and can refer to a high boiling hydrocarbon fraction, separated from the hydrocracker effluent, that can boil at temperatures above those representative of diesel boiling range hydrocarbons. Generally, the unconverted oil has a T1 of at least about 250° C., typically at least about 288° C., and often at least about 316° C. In many cases this higher boiling fraction will represent a minor amount (e.g., no more than about 45%, by volume) of the hydrocracker effluent, due to the significant extent of cracking reactions occurring in the hydrocracking reactor or reaction zone to provide lower molecular weight products. The distillation end point of the unconverted oil is generally close to that of the feedstock. When VGO is used as a major component of, or as the entire, fresh feed component, the unconverted oil typically has a T99 of no more than about 593° C. (e.g., in the range of about 510-about 593° C.), and often at most about 566° C. When DAO is used as a component of, or as the entire, fresh feed component, the unconverted oil can have a distillation end point of at least about 700° C. Recycled UCO within a residue process unit may be abbreviated as "RCO".

As used herein, the term "true boiling point" may be abbreviated "TBP" and can mean a test method for determining the boiling point of a material that corresponds to ASTM D-2892-13 for the production of a liquefied gas, distillate fractions, and residuum of standardized quality on which analytical data can be obtained. The determination of yields of the above fractions by both mass and volume from a graph of temperature versus mass percent distilled is produced using fifteen theoretical plates in a column with about a 5:1 feed:reflux ratio. Such distillation points may be characterized by the nomenclature T5, T50, T85, and the like. Generally, the designation means the amount of material, by mass, that has distilled from a sample at a given temperature. As an example, a "T5 of 200° C." means that 5%, by mass, of a sample has distilled at 200° C.

As used herein, the term "diesel cut point" can be about 343-about 399° C. using the TBP distillation method.

As used herein, the term "diesel boiling range" can mean hydrocarbons boiling in the range of at least about 132° C. or the diesel cut point using the TBP distillation method.

As used herein, the term "diesel conversion" can mean conversion of feed that boils above the diesel cut point to material that boils at or below the diesel cut point in the diesel boiling range.

As used herein, the term "heavy polynuclear aromatics" may be abbreviated "HPNA" and can characterize compounds having seven or more "benzene rings" typically produced in a hydrocracking reaction zone. Such heavy polynuclear aromatics may also be referred to as polynuclear aromatics.

As used herein, the term "coronene" can mean a polycyclic aromatic hydrocarbon including six peri-fused benzene rings and have the chemical formula $C_{24}H_{12}$.

As used herein, the term "initial boiling point" can mean the temperature of a liquid at which its vapor pressure is equal to the standard pressure (101.3 KPa), i.e., the first gas bubble appears.

As used herein, the term "American Petroleum Institute gravity" may be abbreviated "API gravity" and can be a measure of how heavy or light a petroleum liquid is compared to water.

As used herein, the term "degrees Celsius" may be abbreviated "° C.", "hour" may be abbreviated "hr", "meter cubed" may be abbreviated "$m^3$", "mega Pascal" may be abbreviated "MPa", and the term "kilo Pascal" may be abbreviated "KPa".

As depicted, process flow lines in the figures can be referred to interchangeably as, e.g., lines, pipes, feeds, parts, portions, remainders, effluents, products, or streams.

DETAILED DESCRIPTION

Figure 1:
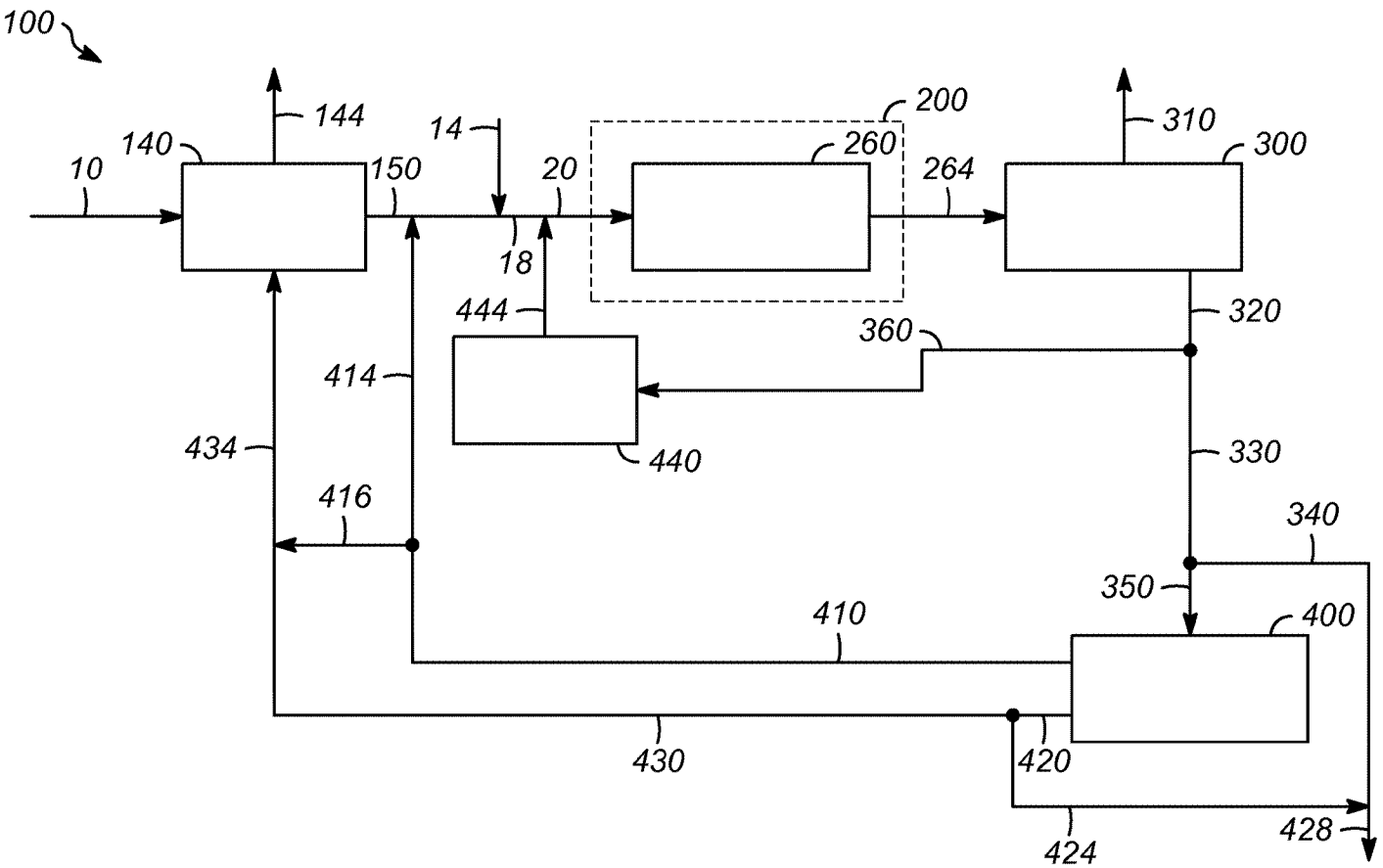
FIG. 1 is a schematic depiction of an exemplary unit for producing a diesel fuel.

Exemplary units are disclosed for producing a diesel fuel. Effective HPNA management at an HC zone can be used to maximize fuel production and lengthen catalyst cycle life. Typically a significant off-plot UCO purge is required when a feed component from a DAO is being processed to prevent HPNA accumulation in the unit. In one exemplary embodiment, two specific techniques are used for HPNA management at the HC zone. The first technique involves use of a carbon-bed adsorption technology on an RCO stream. The second technique involves re-routing a portion or all of the off-plot UCO purge as a feed component to the SDA zone.

This external recycle of UCO to the SDA zone can provide several benefits. These benefits include providing an avenue for incremental HPNA rejection to the SDA pitch while recovering the bulk of the recycled UCO (as an enhanced DAO stream) for further processing at the HC zone. Other benefits may include enabling increased hydrocarbon liquid fuel production, such as naphtha, jet, or diesel, at the HC zone and reducing the off-plot UCO purge requirement, and providing the potential of increased extraction efficiency and reduced pitch production at the SDA zone. Enhancing DAO solvency in the SDA zone by recycling the UCO to obtain a higher quality or greater production of an HC feedstock. A higher quality HC feedstock permits greater conversion and/or longer cycle length. As an example, about 100 tons per day of RCO can result in about 160 tons or more per day of DAO effluent. Moreover, embodiments disclosed herein can provide significantly enhanced conversion within the integrated HC zone and SDA zone system.

To maximize overall conversion and flexibility, the embodiments herein can also incorporate an option to include separation of the UCO into a light UCO stream and a heavy UCO stream typically being laden with HPNAs. This separation via steam stripping fractionation or WFE may allow a selective disposition of the light UCO and heavy UCO. The light UCO may be routed as a direct internal recycle in the HC zone or as an indirect external recycle to the SDA zone, which can be adjusted as plant operations dictate, such as SDA zone operability. Usually, the bulk of the heavy UCO stream is routed to the SDA zone for HPNA rejection while a portion may or may not be produced as a small off-plot purge.

Generally, effective HPNA management at the HC zone is critical in order to maximize fuel production and attain lengthened catalyst cycles. Often, this embodiment utilizes an SDA zone as the primary tool to manage HPNAs at the HC zone. Two flow schemes may be used to demonstrate these ideas. In one exemplary embodiment, a portion or the whole UCO stream may be sent to an SDA zone before recycling back to the HC zone. In another exemplary embodiment, the feed to the HC zone is first fractionated by a distillation column. The light fraction may be directly sent to the HC zone while the heavy fraction is combined with the UCO and then extracted by the SDA zone before entering the HC zone. Precursors of HPNAs are typically present in the heavy cut of the feed. Some feeds such as heavy coker gas oil (HCGO) might even already contain HPNAs in their heavier fractions. Particularly, some VGO feeds have a significant amount of HPNA precursors, such as coronenes. Removal of both HPNAs and HPNA precursors would enhance refinery operation stability and increase catalyst cycle length.

One exemplary embodiment of a residue processing unit 100 is depicted in FIG. 1. Generally, the residue processing unit 100 includes a solvent deasphalting (SDA) zone 140, a hydroprocessing (HP) zone 200, a hydroprocessing fractionation (HPF) zone 300, an unconverted oil fractionation (UCOF) zone 400, and an adsorption zone 440. Exemplary SDA and hydroprocessing zones are disclosed in, e.g., US 2010/0326883. A hydrocarbon feed 10 can include any heavy hydrocarbon fraction, such as a vacuum gas oil, a vacuum residue (VR), or an atmospheric residue. The hydrocarbon feed 10 may include other heavy hydrocarbon feedstocks, such as heavy bottoms from crude oil, heavy bitumen crude oil, shale oil, tar sand extract, deasphalted residue, heavy coker gas oils, products from coal liquefaction, and vacuum reduced crudes. Fresh hydrocarbon feedstocks also include mixtures of the above hydrocarbons and the foregoing list is not comprehensive.

The hydrocarbon feed 10 may be provided to the SDA zone 140. In one exemplary embodiment, the hydrocarbon feed 10 includes pitch, AR, or VR, or a combination of VR and VGO. The SDA zone 140 may include an extraction column, a separator, and a stripper. Generally, the hydrocarbon feed 10 is admixed with a solvent, which can include portions of fresh and make-up solvents. The extraction column typically operates at a temperature of about 93-about 204° C., and a pressure of about 3.8-about 5.6 MPa. Often, the solvent includes one or more light paraffinic hydrocarbons such as propane, butane, pentane or mixtures thereof that solubilizes the heavy hydrocarbon material in the heavy hydrocarbon feed. Propane is one suitable solvent, which may have a low solubility to HPNAs to facilitate their rejection. The light paraffinic solvent solubilizes the heavy hydrocarbon paraffinic material in the hydrocarbon feed 10.

Usually, about 20-about 85%, by weight, of the hydrocarbon feed 10 is extracted, and this extracted portion contains the lowest molecular weight and the most paraffinic portion of the VR and is most suitable for secondary upgrading such as in catalytic hydroprocessing. Often, the bottoms or asphaltene stream contains a large portion of the contaminants such as Conradson carbon residue and metals and has a high density of about 5-about −10 API gravity, and commonly of about 0-about 10 API gravity. This SDA rejection stream 144 may also have high concentrations of HPNAs.

Additionally, lighter hydrocarbons, including diesel fractions, can separate from the heavier fractions and pass with the solvent to the separator for parting and recycling the solvent to the extraction column Usually, the separator operates at a temperature of about 177-about 287° C., and a pressure of about 3.8-about 5.2 MPa. The remaining portion can be sent to the stripper to remove and recycle additional solvent. Often, the stripper operates at a temperature of about 149-about 260° C., and a pressure of about 344-about 1,034 KPa. The heavier fractions can pass as an SDA effluent 150 from the SDA zone 140. An SDA rejection stream 144 can be withdrawn from the SDA zone 140 and include the heaviest hydrocarbon fractions, such as asphalt, and other impurities. The rejection stream 144 can also include HPNAs, and HPNA precursors such as coronenes.

The SDA effluent 150 can be combined with a stream 414, as hereinafter described, and another hydrocarbon feed 14, which may include at least some of the hydrocarbon material described above for the hydrocarbon feed 10. In one exemplary embodiment, the hydrocarbon feed 14 typically includes a VGO. This combined stream 18 can be added to an effluent 444 and provided as an HP zone feed 20. The HP zone 200 can receive the HP zone feed 20 and include an HC zone 260 having a catalytic hydrocracking reactor with one or more fixed beds of the same or different catalysts.

In one exemplary embodiment, the catalytic hydrocracking catalysts utilize amorphous bases or low-level zeolite bases combined with one or more metal hydrogenating components from groups 6 and 8-10 of the periodic table. In another embodiment, the catalytic hydrocracking reactor contains a catalyst having any suitable crystalline zeolite cracking base upon which is deposited a minor portion of a metal hydrogenating component from groups 8-10 of the periodic table. Additional hydrogenating components may be selected from group 6 for incorporation with the zeolite base. The zeolite cracking bases are sometimes referred to as molecular sieves and are usually composed of silica, alumina and one or more exchangeable cations, such as sodium, magnesium, calcium and rarer metals. They may be further characterized by crystal pores of relatively uniform diameter of about 4-about 14 Angstroms. It is preferable to employ zeolites having a relatively high silica to alumina mole ratio of about 3:1-about 12:1. Suitable zeolites found in nature include, for example, mordenite and faujasite. Suitable synthetic zeolites include, for example, the B, X, Y and L crystal types, for example, synthetic faujasite and mordenite. The preferred zeolites are those having crystal pore diameters of about 8-about 12 Angstroms, where the silica to alumina mole ratio is about 4:1-about 6:1. Usually, the zeolites, which are preferably used for the base of catalytic hydrocracking catalysts, are readily commercially available.

The active metals employed in the preferred catalytic hydrocracking catalysts as hydrogenation components are at least one of groups 8-10 of the periodic table, e.g., iron, cobalt, nickel, ruthenium, rhodium, palladium, osmium, iridium and platinum. In addition to these metals, other promoters may also be employed in conjunction therewith, including one or more metals of group 6, e.g. molybdenum and tungsten. The amount of hydrogenating metal in the catalyst can vary within wide ranges. Broadly speaking, any amount between about 0.05-about 30%, by weight, based on the weight of the catalyst may be used. In the case of the noble metals, it is normally preferred to use about 0.05-about 2%, by weight, based on the weight of the catalyst.

The preferred method for incorporating the hydrogenating metal is to contact the base material with an aqueous solution of a suitable compound of the desired metal where the metal is present in a cationic form. Following the addition of the selected hydrogenating metal or metals, the resulting catalyst powder may then be filtered, dried, pelleted with added lubricants, binders or the like if desired, and calcined in air at a temperature of, for example, of about 371-about 648° C. in order to activate the catalyst and decompose ammonium ions. Alternatively the base may first be pelleted followed by the addition of the hydrogenating component and activation by calcining. The foregoing catalysts may be employed in undiluted form or the powdered zeolite catalyst may be mixed and copelleted with other relatively less active catalysts, diluents or binders, such as alumina, silica gel, silica-alumina cogels, activated clays and the like, in proportions ranging from about 5-about 90%, by weight, based on the weight of the catalyst. These diluents may be employed as such or they may contain a minor proportion of an added hydrogenated metal, such as at least one metal of group 6 and/or groups 8-10 of the periodic table.

The catalytic hydrocracking is conducted in the presence of hydrogen and preferably at catalytic hydrocracking reactor conditions, which may include a temperature of about 204-about 482° C. and a pressure of about 3.5-about 20.8 MPa. In addition, catalytic hydrocracking conditions may include a liquid hourly space velocity of about 0.1-about 30 $hr^{-4}$, and a hydrogen circulation rate of about 337-about 4,200 normal $m^3/m^3$. The catalytic hydrocracking is conducted over a fixed catalyst bed in down flow.

An HC effluent 264 from the HC zone 260 or HP zone 200 can be sent to the HPF zone 300. The HPF zone 300 may include one or several vessels, such as a stripper vessel and an atmospheric column but in an aspect may be just a single column. An inert gas such as medium pressure steam may be fed near the bottom of the fractionation column. The fractionation column produces an overhead product 310, which may include one or more of naphtha, kerosene, and diesel boiling range hydrocarbons. The fractionation column can operate at a cut point to provide one or more hydrocarbons having a T1 of at least about 250° C., typically at least about 288° C., and often at least about 316° C., in the stream 320. The stream 320 can be at least a portion or all of an UCO stream from the HPF zone 300. The stream 320 can be either sent to the SDA zone 140 entirely or split into one part 330 having UCO and yet another part or an RCO stream 360 having UCO. The amount of the split between the one part 330 and yet another part 360 can be in any suitable proportion. As an example, if no adsorption zone 440 is present, the one part 330 can include about 100%, by weight, of the at least a portion of the UCO stream 320. If there is not an SDA zone 140, the yet another part 360 can include all of the UCO stream 320. Optionally, another part or purge stream 340 of the one part 330 may be taken. As such, another part or purge stream 340 can be no more than about 5%, by weight, of the one part 330. Generally, the RCO stream 360 is sent to the adsorption zone 440.

The adsorption zone 440 can receive the RCO stream 360 and the adsorption zone 440 can include one or a plurality of beds. Each bed may, independently, include a fixed bed of a small diameter particulate adsorbent, preferably inert. The adsorbent can include at least one of a silica gel, an activated carbon, an activated alumina, a silica-alumina gel, a clay, and a molecular sieve. Preferably, the adsorbent is rich in carbon. Charcoals can therefore be comprised in a preferred adsorbent. Desirably, the charcoal is substantially free of metals and may be derived from coconuts or other low metal content organic material. Exemplary adsorbents are disclosed in, e.g., U.S. Pat. No. 4,775,460. Often, an activated carbon adsorbent, e.g., activated charcoal, typically results in the selective separation of the HPNAs from the UCO boiling range hydrocarbons and the accumulation of these polycyclic compounds on the activated carbon. The adsorption zone 440 can be operated at a pressure of about 340-about 3,500 KPa, and at a temperature of about 120-about 320° C., preferably at least about 260° C. Desirably, the space velocity for the adsorption zone 440 can be about 0.5-about 2.5 $hr^{-1}$. An effluent 444 of the adsorption zone 440 can be recycled upstream of the HP zone 200 and downstream of the SDA zone 140 and the another hydrocarbon feed 14.

A remainder of the one part 330 can be a UCOF zone feed 350 and be provided to the UCOF zone 400. The UCOF zone 400 may include one or several vessels, such as a stripper vessel, an atmospheric column, and a vacuum column, but in an aspect may be just a single column. An inert gas such as medium pressure steam may be fed near the bottom of the fractionation column Generally, the fractionation column produces a light UCO stream 410 and a heavy UCO stream 420. The fractionation column can operate at a cut point to provide one or more hydrocarbons having an initial boiling point of at least about 379° C., about 450° C., about 505° C., or even about 530° C., in the stream 420. Generally, the light UCO stream 410 is split into the stream 414 forming some or a portion of the stream 410 and a stream 416. The split can be accomplished using any suitable separation device, such as a fractionation column using steam stripping or WFE. The stream 414 can be at least about 90%, or even about 100%, by weight, of the light UCO stream 410, although the split can be adjusted based on operational conditions and more material may be sent to the SDA zone 140. The heavy UCO stream 420 can exit the UCOF zone 400 and a purge stream 424 can be some of the stream 420 and be combined with the purge stream 340 to form a combined purge stream 428. Next, the remainder stream 430 can optionally be combined with the stream 416 to form a combined stream 434 to the SDA zone 140. Thus, this exemplary embodiment can improve conversion by recycling the UCO to the SDA zone 140 and/or the HP zone 200 after passing the UCO through the adsorption zone 440.

Figure 2:
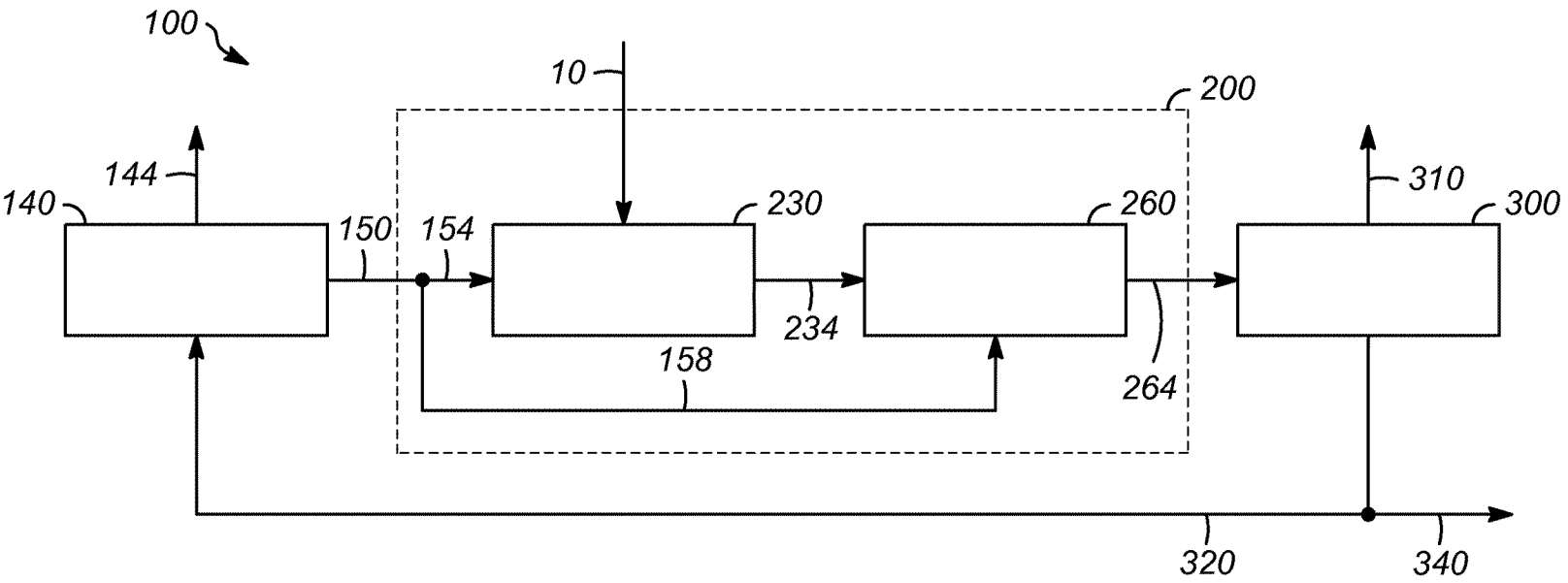
FIG. 2 is a schematic depiction of another version of the exemplary unit for producing a diesel fuel.

Another exemplary embodiment of a residue processing unit 100 is depicted in FIG. 2. This version includes the SDA zone 140, HP zone 200, and the HPF zone 300. The HP zone 200 can include a hydrotreating (HT) zone 230, in addition to the HC zone 260. The HT zone 230 upstream of the HC zone 260 can remove materials that deactivate the catalytic hydrocracking catalyst and prepare the portion 154 for catalytic hydrocracking. The HT zone 230 can include a hydrotreating reactor, as well as other vessels, such as separators, adsorbers, and strippers. The hydrotreating reactor can contain a hydrotreating catalyst and be operated at hydrotreating conditions sufficient to reduce the level of metal compounds, sulfur and nitrogen compounds and saturate hydrocarbons. The hydrotreating reactor is typically operated at a temperature of about 204-about 482° C., and a pressure of about 3.5-about 20.8 MPa.

Hydrotreating can refer to processes using a hydrogen-containing treat gas in the presence of suitable catalysts in a fixed bed. The catalysts may be primarily active for the removal of heteroatoms, such as sulfur, nitrogen and metals and for some hydrogenation of aromatic compounds. Suitable hydrotreating catalysts can be any known conventional hydrogenation catalysts and include those that are comprised of at least one metal of groups 8-10, preferably iron, cobalt and nickel, more preferably cobalt and/or nickel, and at least one group 6 metal, preferably molybdenum and tungsten, on a high surface area support material, preferably alumina. In some exemplary embodiments, more than one type of hydrotreating catalyst may be used in the same hydrotreating reactor or vessel. The metal of groups 8-10 is typically present in an amount ranging from about 2-about 20%, by weight, preferably about 4-about 12%, by weight, based on the total catalyst weight. The group 6 metal is typically present in an amount ranging from about 1-about 25%, by weight, typically about 2-about 25%, by weight, based on the total catalyst weight.

In this exemplary embodiment, the hydrocarbon feed 10 can be provided to the HT zone 230. An effluent 234 from the HT zone 230 can be provided to the HC zone 260, which in turn may provide an effluent 264 to the HPF zone 300. The HPF zone 300 can operate as before, to provide a product 310 containing, e.g., one or more diesel boiling range hydrocarbons and the at least a portion of the UCO stream 320. In this exemplary embodiment, substantially all of the UCO stream 320 can be recycled, which can be considered an RCO stream, to the SDA zone 140 to destroy and/or remove the HPNAs and their precursors. Optionally, the purge stream 340 removes a portion of the UCO stream 320 to prevent accumulation of HPNAs. At the SDA zone 140, an SDA rejection stream 144 can be obtained along with an SDA effluent 150. The SDA effluent 150 can be split into a portion 154 and another portion 158 by passing the HT zone 230 and provided directly to the HC zone 260. Generally, no more than about 10%, by weight, of the SDA effluent 150 is sent to the HT zone 230 for destroying and controlling the HPNA content. In some preferred operations, all of the SDA effluent 150 can bypass the HT zone 230. This scheme can allow operational flexibility to alter the operation of the SDA zone 140 or the amount of the another portion 158. As an example, operating the SDA zone 140 can be operated in severe conditions to minimize the amount of the another portion 158. The effluent 264 from the HC zone 260 may be sent to the HPF zone 300.

Figure 3:
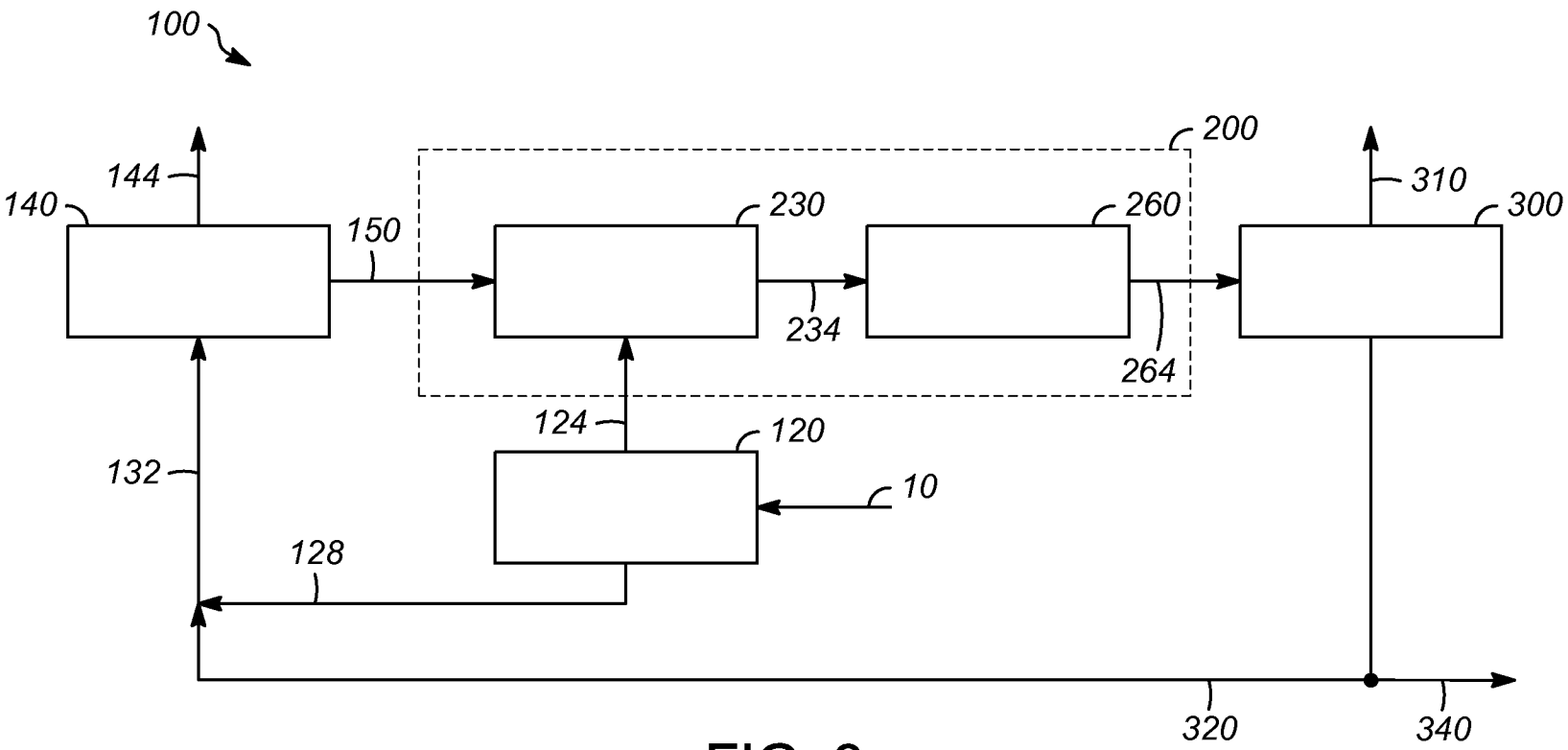
FIG. 3 is a schematic depiction of yet another version of the exemplary unit for producing a diesel fuel.

Referring to FIG. 3, yet another exemplary embodiment of a residue processing unit 100 is depicted. This version can be similar to the residue processing unit 100 discussed above in conjunction with FIG. 2, and include the SDA zone 140, the HP zone 200, and the HPF zone 300, and additionally a feed fractionation zone 120. The feed fractionation zone 120 can provide a light feed stream 124 and a heavy feed stream 128. The HPNAs and their precursors can be concentrated in the heavy feed stream 128 and sent to the SDA zone 140 for destroying and/or removing these compounds. The feed fractionation zone 120 can include one or several vessels, such as a stripper vessel and an atmospheric column but in an aspect may be just a single column. An inert gas such as a medium pressure steam may be fed near the bottom of the fractionation column. The fractionation column can be operated at any suitable conditions to provide a cut point to produce the heavy feed stream having an initial boiling point of at least about 340° C.

In operation, the hydrocarbon feed 10 can be provided to the feed fractionation zone 120. The light feed stream 124 can be provided to the HT zone 230 and the heavy feed stream 128 can be combined with the at least a portion of a UCO or RCO stream 320 to form a combined feed stream 132. The combined feed stream 132 may be provided to the SDA zone 140 to provide an SDA rejection stream 144 and an SDA effluent 150. The SDA effluent 150 along with the light feed stream 124 may be provided to the HP zone 200 including the HT zone 230 and the HC zone 260. Both the SDA effluent 150 and the light feed stream 124 can be provided to the HT zone 230, which in turn may provide an effluent 234 to the HC zone 260. The HC zone 260 may supply an effluent 264. The effluent 264 can be provided to the HPF zone 300 to produce the product 310 and the stream 320. Optionally, the purge stream 340 removes a portion of the UCO stream 320 to prevent accumulation of HPNAs. Concentrating the HPNAs and the precursors in the heavy feed stream 128 by using the SDA zone 140 can maximize their destruction and/or removal from the residue processing unit 100.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for producing a diesel fuel, comprising:

A) providing a hydrocarbon feed to a residue processing unit, wherein the residue processing unit comprises:
   1) a solvent deasphalting zone;
   2) a hydroprocessing zone; and
   3) a hydroprocessing fractionation zone;

B) recycling at least a portion of an unconverted oil stream from the hydroprocessing fractionation zone as a recycled unconverted oil stream; and C) sending one part of the at least a portion of the recycled unconverted oil stream to an unconverted oil fractionation zone operating at a cut point providing a light unconverted oil stream downstream of the solvent deasphalting zone and a heavy unconverted oil stream to the solvent deasphalting zone.

2. The process according to claim 1, further comprising purging another part of the at least a portion of the unconverted oil stream prior to the solvent deasphalting zone.

3. The process according to claim 1, further comprising sending yet another part of the at least a portion of the unconverted oil stream to an adsorption zone.

4. The process according to claim 3, wherein the adsorption zone provides an effluent upstream of the hydroprocessing zone.

5. The process according to claim 1, wherein some of the light unconverted oil stream is sent to the solvent deasphalting zone and some of the heavy unconverted oil stream is purged.

6. The process according to claim 5, wherein at least about 90%, by weight, of the light unconverted oil stream is sent downstream of the solvent deasphalting zone and no more than about 5%, by weight, of the heavy unconverted oil stream is purged.

7. The process according to claim 1, wherein substantially all of the unconverted oil stream is recycled to the solvent deasphalting zone.

8. The process according to claim 1, wherein the hydroprocessing zone comprises a hydrocracking zone.

9. The process according to claim 8, further comprising providing a hydrocarbon feed to the hydrocracking zone.

10. The process according to claim 9, wherein the hydrocarbon feed comprises a vacuum gas oil.

11. A process for producing a diesel fuel, comprising:

A) providing a hydrocarbon feed to a residue processing unit, wherein the residue processing unit comprises:
   1) a solvent deasphalting zone;
   2) a hydroprocessing zone; and
   3) a hydroprocessing fractionation zone;

B) recycling at least a portion of an unconverted oil stream from the hydroprocessing fractionation zone;

C) sending one part of the at least a portion of the recycled unconverted oil stream to an unconverted oil fractionation zone providing a light unconverted oil stream downstream of the solvent deasphalting zone and a heavy unconverted oil stream to the solvent deasphalting zone, and D) sending yet another part of the at least a portion of the unconverted oil stream to an adsorption zone.

12. The process according to claim 11, further comprising purging another part of the at least a portion of the unconverted oil stream prior to the solvent deasphalting zone.

13. The process according to claim 11, wherein the adsorption zone provides an effluent upstream of the hydroprocessing zone.

14. The process according to claim 11, wherein some of the light unconverted oil stream is sent to the solvent deasphalting zone and some of the heavy unconverted oil stream is purged.

15. The process according to claim 14, wherein at least about 90%, by weight, of the light unconverted oil stream is sent downstream of the solvent deasphalting zone and no more than about 5%, by weight, of the heavy unconverted oil stream is purged.

16. The process according to claim 11, wherein the hydroprocessing zone comprises a hydrocracking zone.

17. The process according to claim 16, further comprising providing a hydrocarbon feed to the hydrocracking zone.

18. The process according to claim 17, wherein the hydrocarbon feed comprises a vacuum gas oil.

19. A process for producing a diesel fuel, comprising:

A) providing a hydrocarbon feed to a residue processing unit, wherein the residue processing unit comprises:
   1) a solvent deasphalting zone;
   2) a hydroprocessing zone; and
   3) a hydroprocessing fractionation zone;

B) recycling at least a portion of an unconverted oil stream from the hydroprocessing fractionation zone; and C) sending one part of the at least a portion of the recycled unconverted oil stream to an unconverted oil fractionation zone providing a light unconverted oil stream downstream of the solvent deasphalting zone and a heavy unconverted oil stream to the solvent deasphalting zone, wherein some of the light unconverted oil stream is sent to the solvent deasphalting zone and some of the heavy unconverted oil stream is purged.

20. The process according to claim 19, wherein at least about 90%, by weight, of the light unconverted oil stream is sent downstream of the solvent deasphalting zone and no more than about 5%, by weight, of the heavy unconverted oil stream is purged.

* * * * *